US009656846B2

(12) United States Patent
West

(10) Patent No.: US 9,656,846 B2
(45) Date of Patent: May 23, 2017

(54) PAINT CAN TOOL

(71) Applicant: Stephen W West, Mount Clemens, MI (US)

(72) Inventor: Stephen W West, Mount Clemens, MI (US)

( * ) Notice: Subject to any disclaimer, the term of this patent is extended or adjusted under 35 U.S.C. 154(b) by 2 days.

(21) Appl. No.: 14/766,083

(22) PCT Filed: May 26, 2015

(86) PCT No.: PCT/US2015/032464
§ 371 (c)(1),
(2) Date: Aug. 5, 2015

(87) PCT Pub. No.: WO2015/179870
PCT Pub. Date: Nov. 26, 2015

(65) Prior Publication Data

US 2016/0264390 A1 Sep. 15, 2016

Related U.S. Application Data

(60) Provisional application No. 62/002,198, filed on May 23, 2014.

(51) Int. Cl.
*B67B 7/44* (2006.01)
*B67B 7/00* (2006.01)
*B67B 7/14* (2006.01)

(52) U.S. Cl.
CPC ..... *B67B 7/44* (2013.01); *B67B 7/14* (2013.01); *B67B 7/24* (2013.01)

(58) Field of Classification Search
CPC ..... B67B 7/24; B67B 7/44; B67B 7/14
USPC ..... 81/3.55
See application file for complete search history.

(56) References Cited

U.S. PATENT DOCUMENTS 908,346 A * 12/1908 Smith ..... B67B 7/30 30/408
2,103,008 A * 12/1937 Kinast ..... B25F 1/00 254/21
3,844,321 A * 10/1974 Cook ..... B25D 1/00 273/DIG. 8
4,039,012 A * 8/1977 Cook ..... B25D 1/02 473/333
4,234,988 A * 11/1980 Ross ..... B67B 7/30 30/450
5,127,121 A * 7/1992 Bossie ..... B25D 1/02 30/358
5,212,869 A * 5/1993 Zacharchuk ..... B67B 7/24 30/366

(Continued)

*Primary Examiner* — Marc Carlson
(74) *Attorney, Agent, or Firm* — Cargill & Associates, PLLC; Lynn E. Cargill

(57) ABSTRACT

Disclosed is a device and method for a unitary paint can hand tool with a combination of a pry tab for lifting a paint can lid, a piercing tip to pierce the paint can gutter, a depth stop to stop the piercing tip from going too far into the gutter and a hammer on the proximal end for pounding the lid back onto the paint can. It creates an all in one tool that is perfect for a painter to use, without the need to carry around three separate tools. My unitary tool replaces the old way of doing things with a screwdriver for prying, an awl and a hammer for punching the gutter, and a soft hammer to reseal the lid back on the paint can.

12 Claims, 9 Drawing Sheets

(56) References Cited

U.S. PATENT DOCUMENTS

| | | | | | |
|---|---|---|---|---|---|
| 5,546,625 | A * | 8/1996 | Mealey, Sr. | B05C 21/00 | 15/105 |
| 5,568,665 | A * | 10/1996 | Fick | B67B 7/44 | 30/366 |
| D393,195 | S | 4/1998 | Rose, III | | |
| 5,778,472 | A * | 7/1998 | Lang | B25G 1/10 | 7/151 |
| D422,860 | S * | 4/2000 | Vinar | D8/40 | |
| 6,199,452 | B1 * | 3/2001 | Vinar | B67B 7/14 | 81/3.36 |
| 6,360,444 | B1 * | 3/2002 | Fluhr | B67B 7/44 | 30/366 |
| D513,467 | S * | 1/2006 | Lamphere, III | D8/14 | |
| 8,646,361 | B2 * | 2/2014 | Minnette | B67B 7/14 | 7/105 |
| 2008/0178393 | A1 * | 7/2008 | Kinskey | B25F 1/02 | 7/105 |
| 2010/0229689 | A1 * | 9/2010 | Minnette | B67B 7/14 | 81/3.55 |
| 2015/0143956 | A1 * | 5/2015 | Bober | B67B 7/14 | 81/3.55 |

* cited by examiner

PAINT CAN TOOL

CROSS-REFERENCE TO RELATED APPLICATIONS

This application claims the benefit of priority from Provisional Patent Application No. 62/002,198, filed May 23, 2014.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED, INCLUDING ON A COMPACT DISC

Not Applicable

BACKGROUND OF THE INVENTION

1. Field of the Invention

The present invention relates to paint can tools, methods of manufacturing same, and methods of using same. More particularly, the invention relates to a combination tool including a piercing tip, prying device for paint cans, and resealing hammer.

2. Description of the Prior Art

Painters have long struggled with an issue of opening and resealing a paint can. Conventional methods have included using a screwdriver to open or pry off the paint can lid. They used a pointed object to pierce the gutter to allow the paint that catches in the gutter after pouring to drizzle back down into the can. Hammers are then used to reseal the can lid, but they generally dent them and destroy the perfect seal. This requires at least three different tools to be carried around.

Previous attempts to solve these problems have included a spring loaded gutter punch that was quite complicated, and there have been no recent advancements in this field for many years. Although there have been some attempted unitary tools that have not been designed exactly for the purpose of opening and resealing the can, those unitary prior art tools did not meet with any commercial success.

The industry needs a simple, effective all-in-one tool specific to the need of painters. A pry-tip combination with a piercing tip that will allow optimum resealing is definitely needed. A piercing tip that limits the punctured depth to stop improper size of gutter holes would also be advantageous to the industry.

Conventional gutter punches are well known in the art, including one of the most common types of an awl, or a punch that includes a sharp tip. However, to the best of my knowledge, no one has addressed the issue of punching the gutter in the appropriate place to positively and assuredly punch the hole, so that a true resealing is effected. Since the seal on the paint can is around the inner upper rim, a traditional gutter punch does not effectively seal the rim after the punch hole has been made.

Practitioners of those prior art methods and inventions have become aware of certain problems which are presented by those prior art inventions. One particular problem that has plagued users has been that the previous hammer action used has dented the can lid, leading to incomplete resealing. There are complexities which give rise to imperfect sealing, resulting in drying of a skin on top of the paint.

It would be desirable to the painting industry if there was provided an improved paint can tool, and method of making it, or a method of using a better paint can opening and resealing tool.

SUMMARY OF THE INVENTION

In accordance with the above-noted desires of the industry, the present invention provides various aspects, including a several variations of a paint can tool with a piercing tip and a depth stop. Further, there is disclosed a paint can tool with a piercing tip, a depth stop and a lid pry tab. Lastly, disclosed is a combination prying, gutter punching and resealing tool, as well as methods of making same, and methods of using it. This includes a specifically shaped pry tip, a pre-measured depth piercing tip with its depth stop, and a specific type of hammer end of the tool. This tool overcomes all of the aforementioned problems with the prior art because the pry tip design does not deform the paint can lid, the piercing tip makes the right depth of hole punch in the gutter, and it can be perfectly resealed by the hammer end.

The invention is particularly useful for applications of paint cans of very expensive paints, such as marine paints or car paints, which have become so expensive that even an ounce of paint is a significant cost portion of a re-painting. As marine paint is currently $1800 per gallon, a practitioner does not want to waste any paint, or ruin the container.

Although the invention will be described by way of examples herein below for specific aspects having certain features, it must also be realized that minor modifications that do not require undo experimentation on the part of the practitioner are covered within the scope and breadth of this invention. Additional advantages and other novel features of the present invention will be set forth in the description that follows and in particular will be apparent to those skilled in the art upon examination or may be learned within the practice of the invention. Therefore, the invention is capable of many other different aspects and its details are capable of modifications of various aspects which will be obvious to those of ordinary skill in the art all without departing from the spirit of the present invention. Accordingly, the rest of the description will be regarded as illustrative rather than restrictive.

BRIEF DESCRIPTION OF THE DRAWINGS

For a further understanding of the nature and advantages of the expected scope and various aspects of the present invention, reference shall be made to the following detailed description, and when taken in conjunction with the accompanying drawings, in which parts are given reference numerals, and wherein.

DETAILED DESCRIPTION OF THE INVENTION

Figure 1:
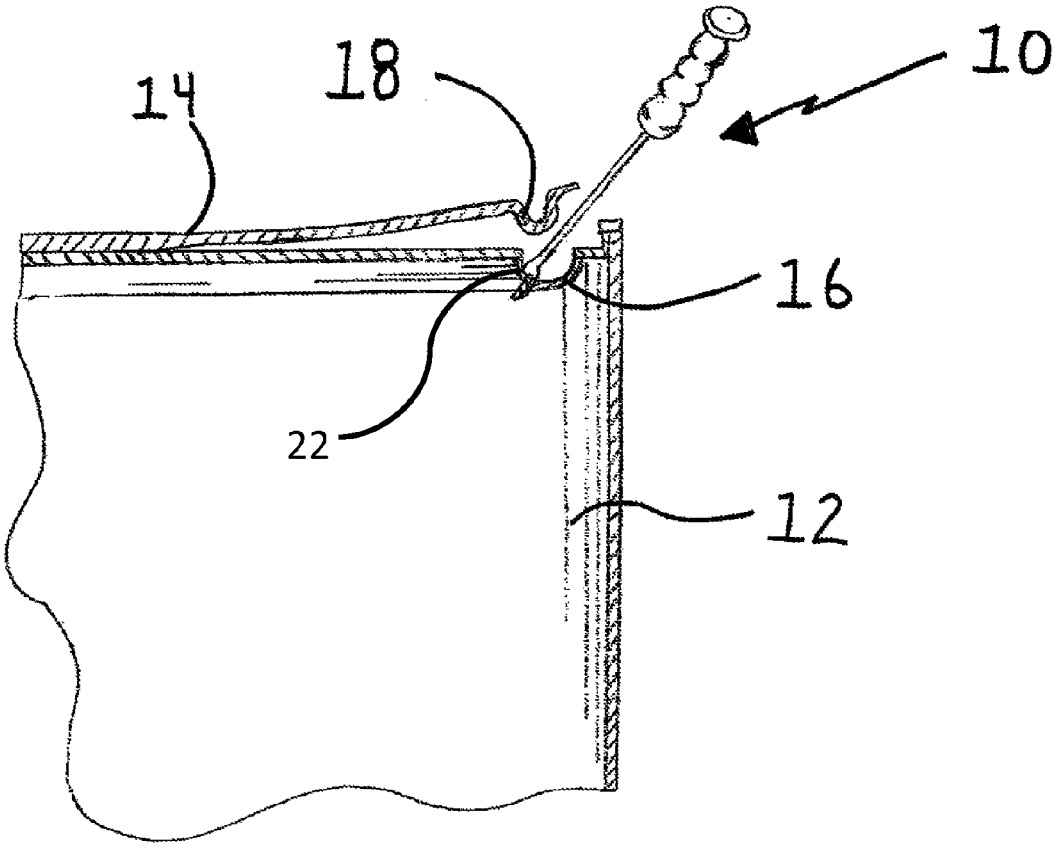
FIG. 1 is a side elevational cutaway view of a combination tool made in accordance with the present invention.

Referring now to the drawings in detail, FIG. 1 is a cutaway view of a combination tool made in accordance with the present invention as generally indicated by the numeral 10, which also includes illustrations of a paint can 12, with a paint can lid 14. Rim groove 16 is shaped to receive lip 18 of paint can lid 14. In practicing the method herein, unitary tool 10 is used to pierce a hole into rim groove 16, preferably on the inner edge of rim groove 16. Unitary tool 10 is made of a shape such that the punch tool provides a predetermined depth of hole in the rim groove 16 by the use of a depth stop 22.

Figure 2A:
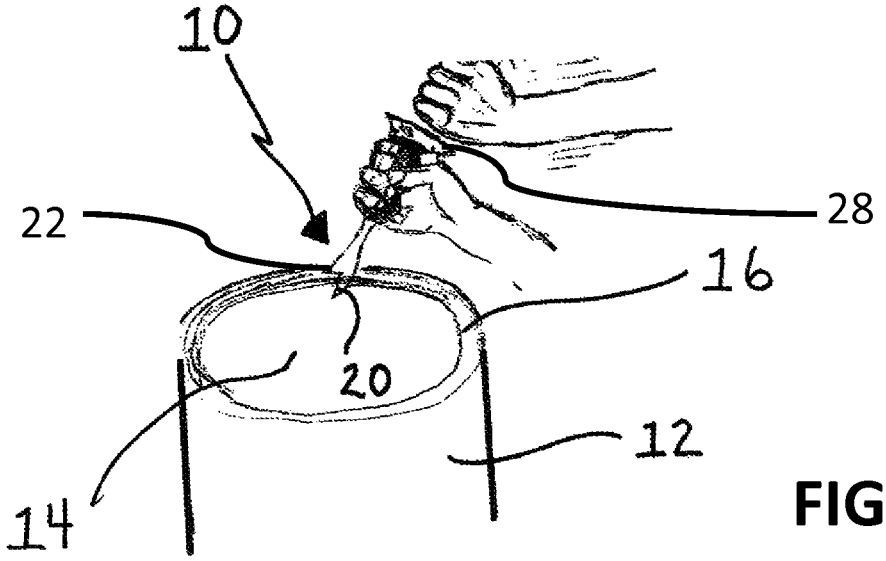
FIG. 2A illustrates an environmental view of the tool being used during the step of gutter punching.
Figure 2B:
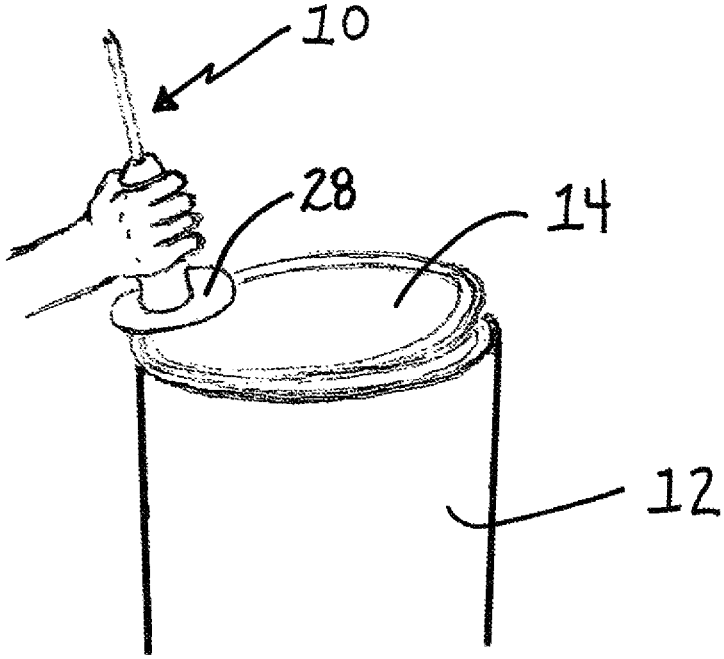
FIG. 2B illustrates an environmental view of the tool being used during the step of resealing.

FIG. 2A shows a piercing tip 20 embedded into rim groove 16. In FIG. 2B, hand tool 10 is shown being used to hammer lid 14 back onto can 12 by hammer 28. After paint has been poured out of the paint can, and when the painter wants to reseal, the method of my invention includes this resealing step where the unitary tool has a hammer end 28 which can be used to hammer down paint can lid 14 back into place on paint can 12.

Figure 3:
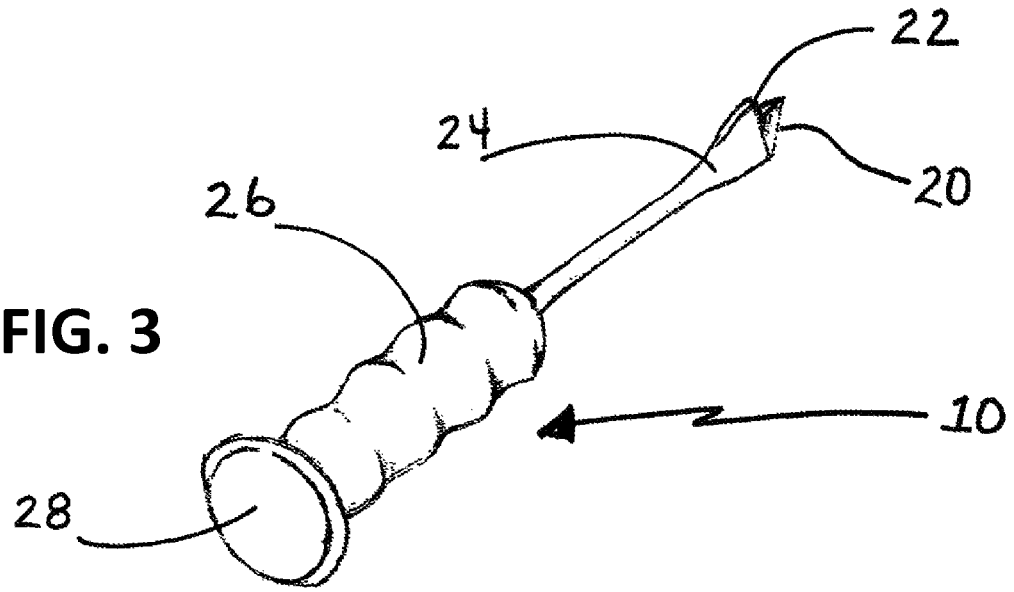
FIG. 3. is an end perspective view of the present invention.

Looking now at FIG. 3, the unitary tool is generally denoted by numeral 10, and includes the piercing tip 20 which provides a predetermined depth of pierced hole in the previously described rim groove, as determined by the depth stop 22. Depth stop 22 also acts as a prying surface used to open up paint can lid 14 from paint can 12. Tool shaft 24 is attached to grip handle 26 having a hammer 28 at the proximal end of grip handle 26. This unitary tool is a combination of a piercing tool 20 and a depth stop 22 while at the other end of shaft 24 is a grip handle 26 with a hammer 28 at the proximal end of it.

Figure 4:
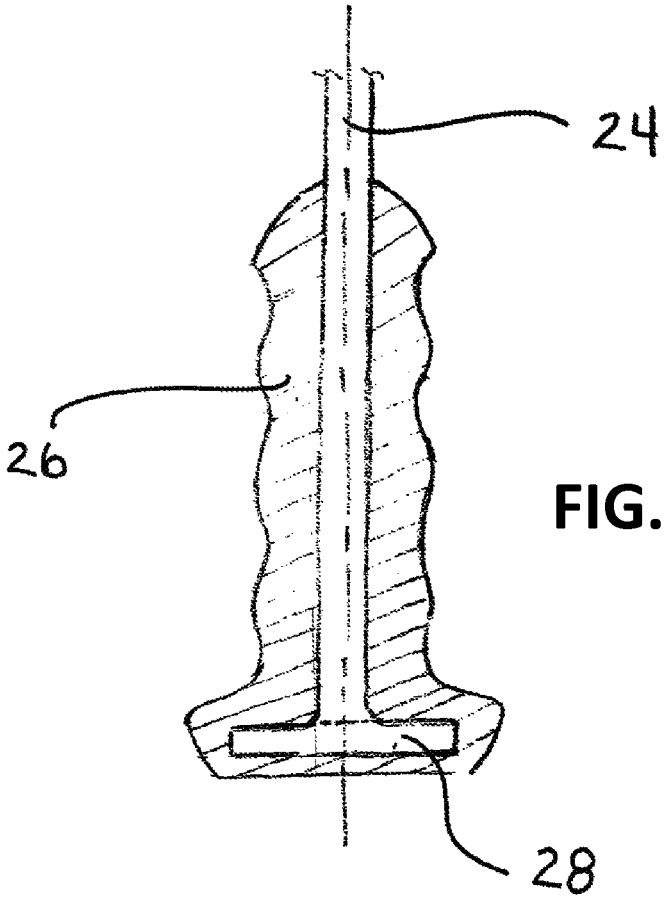
FIG. 4 is a side elevational view of the hammer portion of the tool.

FIG. 4 is a cutaway side elevation view of a first aspect of hammer 28. Hammer 28 is shown as an integral component of tool shaft 24 inside of handle grip 26. Other variations and aspects of the hammer will be discussed in more detail herein below.

Figure 5A:
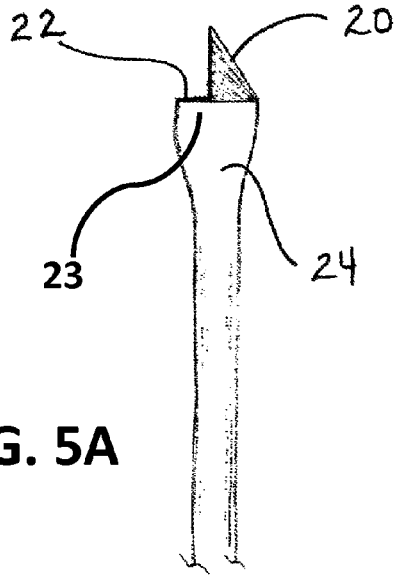
FIG. 5A is a detailed frontal plan elevational view of a first aspect of the pry tip/piercing tip.
Figure 5B:
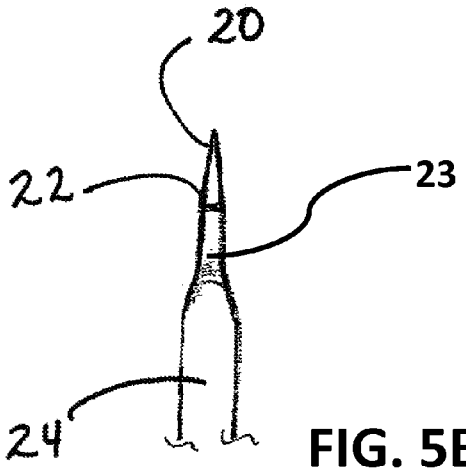
FIG. 5B is a side elevational view of the pry tip/piercing tip of FIG. 5A.
Figure 5C:
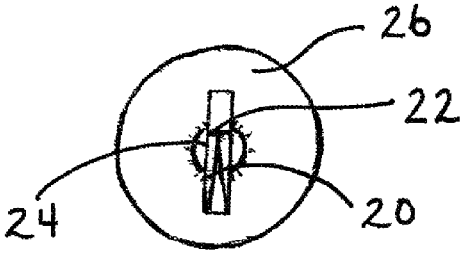
FIG. 5C is a top plan view looking down on the pry tip/piercing tip of FIGS. 5A and 5B.

Referring next to FIG. 5A, the first aspect of my invention is shown with a tapered pry tab 23 and piercing tip 20 that is integral with a depth stop 22, and both may be formed from a tapered shaft 24. FIG. 5B is a side elevational view of the piercing tip of FIG. 5A, and exhibits a straight profile of piercing tip 20. FIG. 5C shows a top plan view of the prying tab and piercing tip of FIG. 5A, and further illustrates a grip handle 26, not shown in FIG. 5A.

Figure 5D:
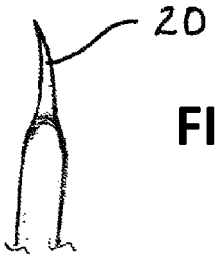
FIG. 5D is a second aspect of the pry tip/piercing tip.

FIG. 5D illustrates a side elevational view of yet another aspect of the present invention in which the piercing tip 20 has a slight arcuate curve in order to puncture the rim groove in the inner upper ridge of the rim groove. This puncture spot may be located on the inside of the sealing point when the paint can lid is securely sealed back onto the paint can itself. As one can imagine, if the piercing tip 20 is inserted under the paint can lid, and the direction of the prying activity is circular in a counterclockwise direction, this arcuate curvature may be more advantageous than a straight tip.

Figure 5E:
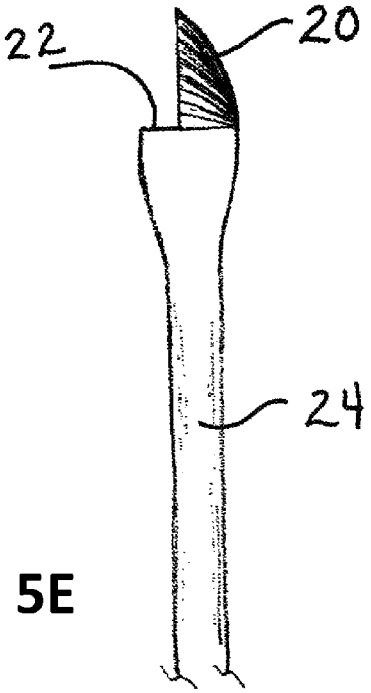
FIG. 5E is a detailed frontal plan elevational view of a third aspect of the pry tip/piercing tip.

FIG. 5E is a frontal view of the tool of FIG. 5D and this view illustrates the placement of the curved piercing tip 20 relative to the depth stop 22 on an elongated shaft 24. Piercing tip 20 is to be used to punch a hole in the rim groove of the paint can, while depth stop 22 will limit the depth of the punched hole to a desirable hole size. If the hole is too big, the paint can will not be effectively resealed, and the top of the remaining paint may form a dried skin. Obviously, this is not desirable, so one would want the punched hole to be only large enough to let the paint left in the rim groove to drip down back into the can after a pour.

Figure 5F:
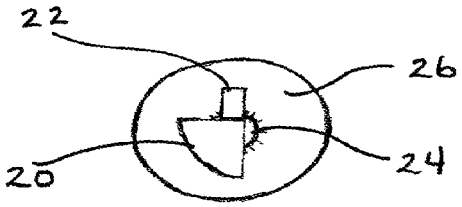
FIG. 5F is a top plan view looking down on the pry tip/piercing tip of FIG. 5E.

FIG. 5F is a top plan view taken of the tool of FIG. 5E, showing the curved surface of the piercing tip 20, the depth stop 22, shaft 24 and grip handle 26.

Figure 6:
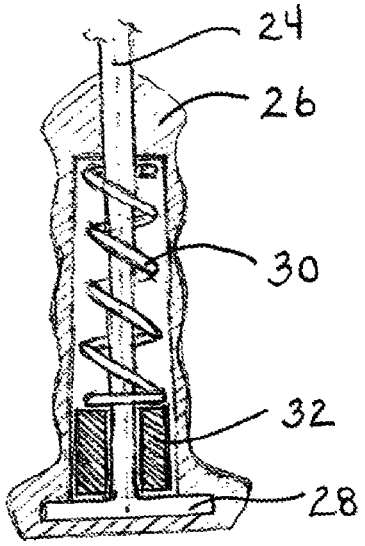
FIG. 6 is a side elevational cutaway view of a second aspect of the hammer portion of the present tool.

FIG. 6 is another cutaway view of a further aspect of the hammer end 28 of my unitary tool. In this aspect, shaft 24 is encircled with a spring mechanism 30, extending from the distal end of grip handle down to the proximal end with hammer 28. A weighted concentric piece 32 increases the hammering mechanism, while spring 30 absorbs shock while hammering.

Figure 7:
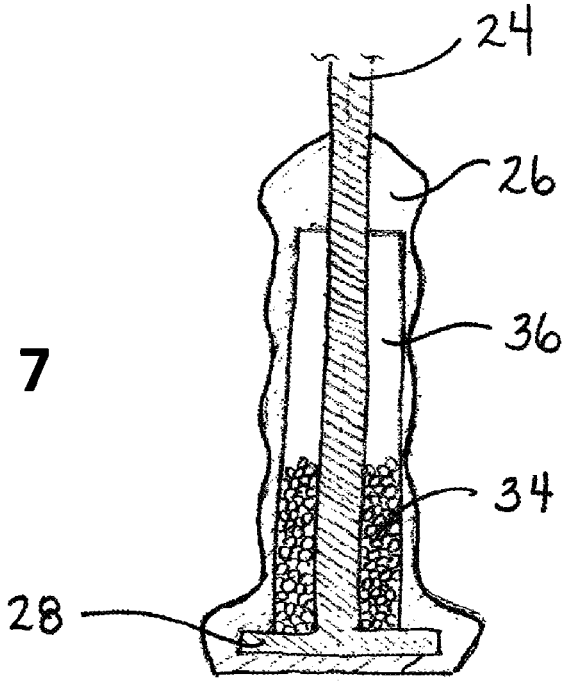
FIG. 7 is a side elevational cutaway view of a third aspect of the hammer portion of the present tool.

FIG. 7 is another aspect of the hammering action, still with hammer 28 at the proximal end of the tool. Hammer 28 is again a termination point for shaft 24 within grip handle 26. However in this aspect, lead shot 34 is encased in a cavity 36. During hammering, lead shot 34 moves up and down in cavity 36 to provide more impact with less jarring and shaking to the operator.

Figure 8:
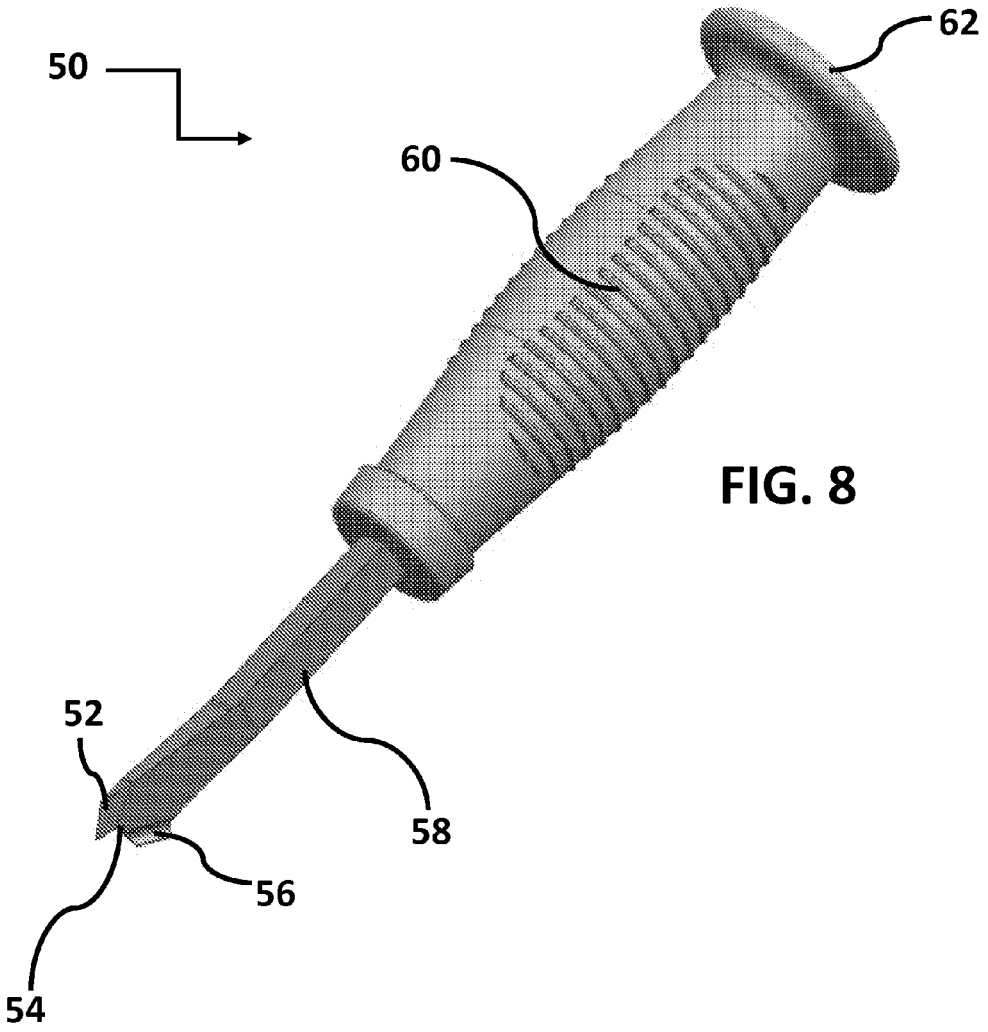
FIG. 8 is a side elevational cutaway view of a fourth aspect of the hammer portion of the present tool.

FIG. 8 shows another aspect of my invention and is generally denoted by numeral 50, again including a piercing tip 52 next to a depth stop 54. Depth stop 54 is integral with pry tab 56, shown here with a curved pry tab. Each of these components is formed integral with shaft 58 extending into handle 60. Tool shaft 58 may be from 1:1 to 0.4:1 times the length of handle 60, and is preferably 1:1 to 0.75:1, providing a nicely proportioned ergonomic design.

Figure 9A:
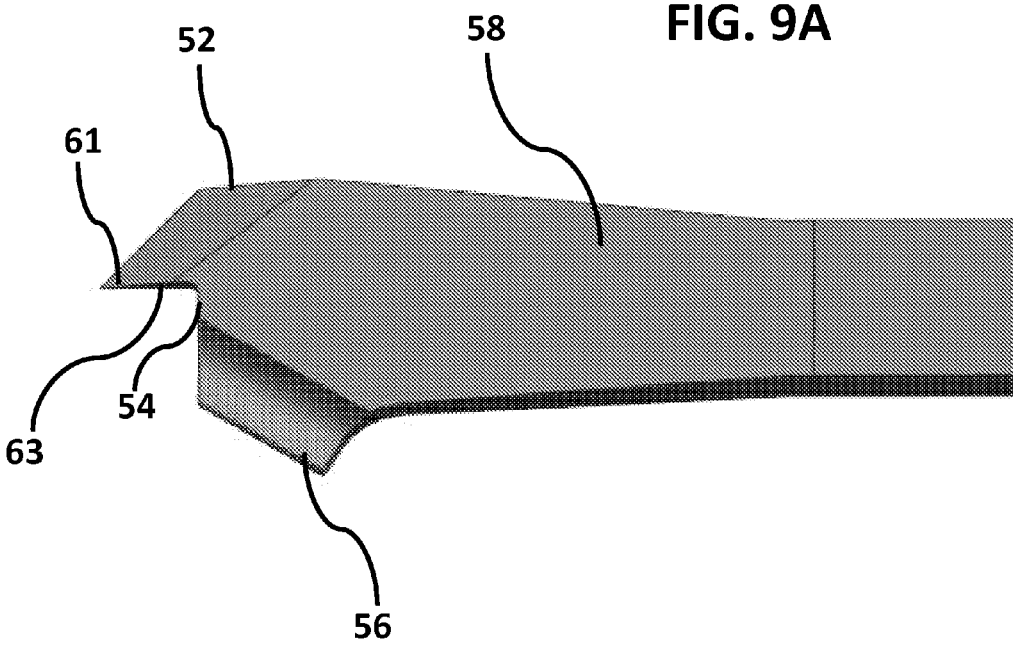
FIG. 9A is a close up detail of the pry tab/piercing tip of this aspect.

FIG. 9A is a close-up detailed look at the distal end of the tool showing piercing tip 52, depth stop 54 and pry tab 56. In this aspect, piercing tip 52 is angled and forms a sharp tip 61 for piercing a paint can gutter. Stop 54 is preferably perpendicular to the lateral side 63 of the piercing tip 52 for efficiency. In this aspect, pry tab 56 has a concave surface and extends out from shaft 58 for easier prying of a paint can lid. As disclosed before, pry tab 56 fits under a paint can lid and can be easily walked around the rim under the paint can lid to remove it from the paint can. This is the first step of the method for my paint can lid management system. The next step is to pierce the paint can gutter, as shown in FIG. 1, using piercing tip 52, either before or after the paint is poured out of the can. This allows paint in the gutter to drip through the pierced hole and return into the can. Thereafter, the lid is put back on the can and pounded down with hammer 62 of FIG. 9 to reseal the can without needing to scoop the excess paint out of the gutter before resealing. Only one tool, want my tool, is needed for the entire operation.

Figure 9B:
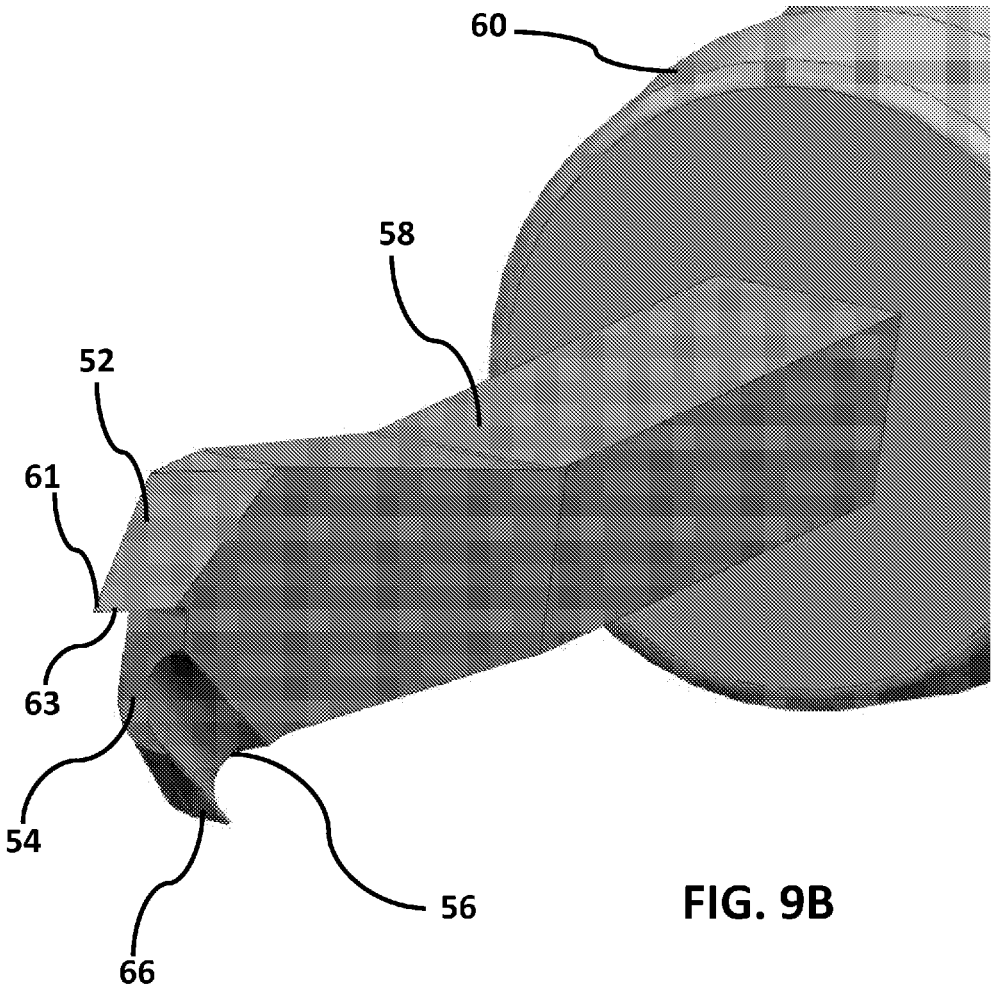
FIG. 9B is an illustration of the pry tab/piercing tip of FIG. 9A from another perspective.

FIG. 9B is yet another view of the paint can tool of FIGS. 8 and 9A, more clearly showing the concave configuration of pry tab 56. As one can see, its lifting lip 66 is configured to more easily pry and lift a paint can lid. The concave surface of pry tab 56 may include an arcuate radial angle of 0° to 180° concavity. Preferably, this is a shallow concave of from 10° to 50°. Depth stop 54 is defined by the upper surface of pry 56 is preferably perpendicular to lateral side 63 of piercing 52, as discussed hereinabove.

The piercing tip 20 may include a distal tip that is either stamped to shape or taper ground to a point having an angle of from 20° to 50°, and may be from about three (3) to about ten (10) mm in length. This length dimension will depend on the size of the paint can being used, so these figures are assuming a one gallon can of paint. The exposed shank may have a stop that permits a punch depth stop of from 30 to 100 mm, while the flattened rectangular profile may have a width of from 1 to 10 mm. Preferably, the ratio of piercing tip to depth stop compared to the overall width of the tip may be 50 to about 80%. The stop shall be sufficiently dimensioned to prevent further puncture. The shank is either initially round which tapers to a rectangular stop punch profile or the shaft may be square, rectangular or any other suitable shape. Any of these may be preferred for ease of manufacturing, while maintaining integrity. Surrounding the shank will be an ergonomic high density foam grip handle with finger grips.

The hammer portion is at the proximal end of the tool, and may exhibit stand up capability. The grip handle may also have a hollow interior with a lead shot in the interior to enhance the hammer action. The handle length may be from 100-150 mm, and the hammer plate may have a depth of from 10-30 mm. Hammer end 28 may be screwed on to the handle. In another aspect of the hammer portion of my invention, there is an internal spring with weights against which the spring interacts. The weights absorb the shock during hammering action. With this design, recoil is alleviated due to the spring absorbing shock. Then there may actually be a secondary blow when the spring releases.

The curved pry and punch tip helps to pry the lid off the paint can because that gives leverage against the can without damaging the outer portion of the rim groove. The radius of the curved pry and punch tip is more suitable to the radius of the can lid. Furthermore, the curved tip can provide a rocking action that is helpful when prying off the paint can lid.

The hammer base may be flat for standing and may be from 40 to 100 mm, and preferably 50-60 mm wide at the hammer end. This hammer base is preferably round, but may be made of any suitable shape, including triangular, rectangular, round, oblong, or square. It may be flat or have short legs or it may be any suitable shape and/or depth.

The tip, shank and hammer of my tool may be made of any suitable material, including, but not limited to, stainless steel, hardened steel, brass or any other hard metal able to withstand hammering. It may be overmolded with a handle made of foam, plastic, wood or any ergonomic rubber or rubber-like material. High impact strength polyurethane may be used for portions of the tool, while softer durometer (5000-50,000) materials could be used for ergonomics. Further, the entire tool could be all metal or all plastic, and made with a wooden handle.

The shank of my tool may have a diameter of from about 30 to 80 mm, although something along the lines of 40 mm is preferred for ease of use. The diameter may be uniform, or may vary in thickness or width. The shank may include a palm rest to prevent hand damage during hammering operations.

Therefore, in accordance with the present invention, a paint can tool is disclosed for opening and resealing a can of paint with a gutter inside the circumference of the paint can, and wherein there is also a paint can lid with a normal rim. This includes a hand tool having a tool shank with a sharply pointed piercing tip at its distal end that is integral with a hand tool handle to pierce a hole in the gutter of the paint can. The piercing tip is capable of piercing a paint can gutter to produce a hole for any paint that is left over from a pour to be able to drip back into the can through the gutter. A depth stop is immediately adjacent the piercing tip to prevent the piercing tip from descending too far into the paint can gutter. This unitary tool actually provides a complete lid management system in one tool that is created for opening and automatically cleaning a paint can gutter prior to resealing with the paint can lid.

In fact, the piercing tip may have a height to width aspect ratio of from 0.25:1 to 1:3, in any shape such as square, rectangular, rhombohedral, triangular, frustoconical, taper ground flat blade, isosceles triangle or combinations thereof. Preferably, the ratio of the width of the stop compared to the width of the base of the immediately adjacent piercing tip is from 0.5:1 to 1:3. The upper flat surface of the stop is generally perpendicular to the piercing tip and is generally the same width as the broadest part of the piercing tip that is immediately adjacent.

Further, disclosed is a lid pry tab extending as a wing laterally from the distal end of the tool shank, integral with the stop and acting as a pry tab for inserting under the rim of the tool to open the paint can lid, wherein the lip pry tab may extend laterally as a wing up to 90 degrees from a longitudinal axis determined by a center line drawn through the tool shaft. Another aspect of my invention includes a design where the lip pry tab is a shallow concave shaped lip with an arcuate curvature of from 0 degrees to 180 degrees. This curvature may make it easier for prying the lid off the can.

Yet even further, disclosed is an integral hammer located on the proximal end of the paint can tool for use as a hammer to pound down the lid to reseal the lid on the can. The ratio of the weight of the hammer end to the total weight of the overall tool is from 0.25:1 to 4:1. The hammer end may include an insert with a relatively flat portion to be inserted into the handle at the proximal end, or we have tried using a threaded brass hammer knob that is threaded onto the proximal end of the handle, although this added a considerable amount of weight. In some instances, however, the extra weight is a desirable thing. The hammer may also include a cavity in the handle for an interior load of shot to increase the impact. Generally, the hammer end is made of a metal such as brass, stainless steel, hardened steel or any other suitable material, or combinations thereof.

In making the hammer end attached to the proximal end of the paint can tool, any suitable method may be used, including being threaded, press fit, surrounding the outer circumference, inserted into the handle, or it may be formed integral with the tool shank and thereafter be covered with a softer material, such as plastic or wood.

In practicing the method of using my unitary paint can tool for opening and resealing a can of paint having a gutter inside the circumference of the paint can and a paint can lid having a rim, the following steps are recommended. First, we provide my unitary paint can tool having a piercing tip and a depth stop with an integral lid pry tab at the distal end of the tool and a hammer on the proximal end of the tool. Then we pry open the lid off of the top of the paint can using the integral pry tab at the distal end of the tool. Either before or after we pour the paint out of the can, we pierce the gutter inside the circumference of the paint can with the piercing tip, being stopped at a predetermined depth by the depth stop next to the piercing tip. Then, we allow the paint in the paint gutter to drip back down into the paint can through the holes made by the piercing tip, and when we are done, we reseal the lid back onto the paint can and hammering on the lid to reseal it with a hammer at the proximal end of the paint can and tool.

A method of manufacturing a paint can tool with a functional distal end and a hammer device on the proximal end is disclosed by stamping out a suitably sized tool shaft to create a broadened distal end. The distal end of the tool shaft is ground down to create a piercing tip and then grinding a flat depth stop immediately adjacent to the piercing tip creates the depth stop. Then the tool shaft is either inserted into a tool handle or the tool handle is overmolded to create the handle. Finally, a substantially flat hammer piece is either inserted into the tool handle, threaded onto the end, or is overmolded into the proximal end of the tool.

This method yields a unitary paint can hand tool with a combination of a pry tab for lifting a paint can lid, a piercing tip to pierce the paint can gutter, a depth stop to stop the piercing tip from going too far into the gutter and a hammer on the proximal end for pounding the lid back onto the paint can. It creates an all in one tool that is perfect for a painter to use, without the need to carry around 3 separate tools. My unitary tool replaces the old way of doing things with a screwdriver for prying, an awl and a hammer for punching the gutter, and a soft hammer to reseal the lid back on the paint can. For each of the elements of my tool, the particular dimensions and ratios have not been seen before, and yield an especially useful tool that punches the exact right hole size in the gutter, and the unique pry tab configuration can easily be "walked" around the can with ease to release the lid, as well as a small hammer on the end that that will not damage the lid or the can.

In summary, numerous benefits have been described which result from employing any or all of the concepts and the features of the various specific aspects of the present invention, or those that are within the scope of the invention.

The foregoing description of a preferred embodiment of the invention has been presented for purposes of illustration and description. It is not intended to be exhaustive or to limit the invention to the precise form disclosed. Obvious modifications or variations are possible in light of the above teachings with regards to the specific aspects. The embodiment was chosen and described in order to best illustrate the principles of the invention and its practical applications to thereby enable one of ordinary skill in the art to best utilize the invention in various aspects and with various modifications as are suited to the particular use contemplated. It is intended that the scope of the invention be defined by the claims which are appended hereto.

INDUSTRIAL APPLICABILITY

The present invention is a paint can lid management tool, method of using and method of manufacturing which finds utility in the painting, restoring and refurbishing arts as a paint can tool that eliminates the need for at least two additional tools.

What is claimed is:

1. A paint can tool for prying off a paint can lid from a paint can, and reducing paint waste, the paint can having a gutter inside a circumference of the paint can and the paint can lid having a rim, comprising:

a substantially cylindrical handle;

a tool shank extending longitudinally along a longitudinal axis from the substantially cylindrical handle, the tool shank having a plurality of tools integrally formed on its distal end; the tools including;

a sharply pointed piercing tip extending longitudinally from the distal end of the tool shank; the piercing tip being sized and shaped for piercing the gutter to produce a hole for any paint that is left over from a pour to be able to drip back into the paint can, thereby reducing paint waste;

a depth stop surface immediately adjacent and substantially perpendicular to the longitudinal axis to prevent the piercing tip from descending too far into the gutter during the piercing; and a curved pry tab adjacent the depth stop surface, the curved pry tab being shaped as an elongated wing laterally offset from the longitudinal axis of the tool shank, the elongated wing being arcuately shaped forming a shallow concave recess between a leading edge of the elongated wing and the tool shank and wherein the leading edge of the elongated wing has a distal end and a proximal end; the concave recess of the elongated wing having a center line parallel to the leading edge of the elongated wing; the center line and the leading edge being oriented at an acute angle relative to the longitudinal axis of the tool shank, wherein a distance between the most distal end of the leading edge of the elongated wing and the longitudinal axis of the tool shank is less than a distance between the most proximal end of the leading edge of the elongated wing and the longitudinal axis of the tool shank, the curved pry tab being sized and shaped for inserting the leading edge of the concave recess of the curved pry tab under the rim of the paint can lid and used to pry off the paint can lid.

2. The paint can tool of claim 1, wherein the piercing tip includes shapes such as square, rectangular, rhombohedral, triangular, frustoconical, taper ground flat blade, isosceles triangle and combinations thereof.

3. The paint can tool of claim 1, wherein the depth stop surface is generally the same width as the broadest part of the piercing tip that is immediately adjacent.

4. A paint can tool for prying off a paint can lid from a paint can, reducing paint waste, and resealing the paint can, the paint can having a gutter inside a circumference of the paint can and the paint can lid having a rim, comprising:

a substantially cylindrical handle sized and shaped to allow it to be used as a hammer for the resealing of the paint can;

a tool shank extending longitudinally along a longitudinal axis from the substantially cylindrical handle, the tool shank having a plurality of tools integrally formed on its distal end; the tools including;

a sharply pointed piercing tip extending longitudinally from the distal end of the tool shank; the piercing tip being sized and shaped for piercing the gutter to produce a hole for any paint that is left over from a pour to be able to drip back into the paint can, thereby reducing paint waste;

a depth stop surface immediately adjacent and substantially perpendicular to the longitudinal axis to prevent the piercing tip from descending too far into the gutter during the piercing; and a curved pry tab adjacent the depth stop surface, the curved pry tab being shaped as an elongated wing laterally offset from the longitudinal axis of the tool shank, the elongated wing being arcuately shaped forming a shallow concave recess between a leading edge of the elongated wing and the tool shank and wherein the leading edge of the elongated wing has a distal end and a proximal end; the concave recess of the elongated wing having a center line parallel to the leading edge of the elongated wing; the center line and leading edge being oriented at an acute angle relative to the longitudinal axis of the tool shank, wherein a distance between the most distal end of the leading edge of the elongated wing and the longitudinal axis of the tool shank is less than a distance between the most proximal end of the leading edge of the elongated wing and the longitudinal axis of the tool shank, the curved pry tab being sized and shaped for inserting the leading edge of the concave recess of the curved pry tab under the rim of the paint can lid and used to pry off the paint can lid.

5. The paint can tool of claim 4, wherein the piercing tip includes shapes such as square, rectangular, rhombohedral, triangular, frustoconical, taper ground flat blade, isosceles triangle and combinations thereof.

6. The paint can tool of claim 4, further comprising an integral hammer plate located on the substantially cylindrical handle of the paint can tool.

7. The paint can tool of claim 6, wherein the ratio of the weight of the hammer plate to the total weight of the overall paint tool is from 0.25:1 to 4:1.

8. The paint can tool of claim 6, wherein the hammer plate is made of a metal such as brass, stainless steel, hardened steel or combinations thereof.

9. The paint can tool of claim 6, wherein the hammer plate is attached to a proximal end of the paint can tool by a connection interface selected from the group consisting of being threaded, press fit, surrounding an outer circumference of the substantially cylindrical handle, inserted into the substantially cylindrical handle, and being formed integral with the tool shank and thereafter being covered with a softer material.

10. A method of using a unitary paint can tool for opening and resealing a paint can having a gutter inside a circumference of the paint can and a paint can lid having a rim, comprising:

providing the unitary paint can tool comprising:

a substantially cylindrical handle sized and shaped to allow it to be used as a hammer for the resealing of the paint can;

a tool shank extending longitudinally along a longitudinal axis from the substantially cylindrical handle, the tool shank having a plurality of tools integrally formed on its distal end; the tools including;

a sharply pointed piercing tip extending longitudinally from the distal end of the tool shank; the piercing tip being sized and shaped for piercing the gutter to produce a hole for any paint that is left over from a pour to be able to drip back into the paint can, thereby reducing paint waste;

a depth stop surface immediately adjacent and substantially perpendicular to the longitudinal axis to prevent the piercing tip from descending too far into the gutter during the piercing; and a curved pry tab adjacent the depth stop surface, the curved pry tab being shaped as an elongated wing laterally offset from the longitudinal axis of the tool shank, the elongated wing being arcuately shaped forming a shallow concave recess between a leading edge of the elongated wing and the tool shank and wherein the leading edge of the elongated wing has a distal end and a proximal end; the concave recess of the elongated wing having a center line parallel to the leading edge of the elongated wing; the center line and leading edge being oriented at an acute angle relative to the longitudinal axis of the tool shank, wherein a distance between the most distal end of the leading edge of the elongated wing and the longitudinal axis of the tool shank is less than a distance between the most proximal end of the leading edge of the elongated wing and the longitudinal axis of the tool shank, the curved pry tab being sized and shaped for inserting the leading edge of the concave recess of the curved pry tab under the rim of the paint can lid and used to pry off the paint can lid;

prying open the paint can lid off the top of the paint can using the concave recess of the pry tab at the distal end of the paint can tool, such that the paint can lid is not deformed and the paint can lid can be replaced and it can be perfectly resealed;

piercing the gutter inside the circumference of the paint can with the piercing tip, stopping at a predetermined depth by the depth stop surface;

allowing the paint in the gutter to drip back down into the paint can through the holes made by the piercing tip; and resealing the paint can lid back onto the paint can and hammering on the paint can lid to reseal the paint can with the substantially cylindrical handle of the paint can tool.

11. A method of manufacturing a unitary paint can tool with a functional distal end and a proximal end, comprising:

stamping out a tool shank to create a broadened distal end;

grinding down the distal end of the tool shank to create a sharply pointed piercing tip;

grinding a depth stop surface immediately adjacent to the piercing tip;

forming a curved pry tab adjacent the depth stop surface; and inserting the tool shank into an end of a substantially cylindrical handle;

thereby yielding the unitary paint can hand tool for opening and resealing a paint can with a combination of the curved pry tab for lifting a paint can lid, a piercing tip to pierce a paint can gutter, a depth stop to stop the piercing tip from going too far into the paint can gutter; the unitary paint can tool comprising:

the substantially cylindrical handle sized and shaped to allow it to be used as a hammer for the resealing of the paint can;

the tool shank extending longitudinally along a longitudinal axis from the substantially cylindrical handle, the tool shank having a plurality of tools integrally formed on the distal end; the tools including;

the piercing tip extending longitudinally from the distal end of the tool shank; the piercing tip being sharply pointed and sized and shaped for piercing the paint can gutter to produce a hole for any paint that is left over from a pour to be able to drip back into the paint can, thereby reducing paint waste;

the depth stop surface immediately adjacent and substantially perpendicular to the longitudinal axis to prevent the piercing tip from descending too far into the paint can gutter during the piercing; and the curved pry tab adjacent the depth stop surface, the curved pry tab being shaped as an elongated wing laterally offset from the longitudinal axis of the tool shank, the elongated wing being arcuately shaped forming a shallow concave recess between a leading edge of the elongated wing and the tool shank and wherein the leading edge of the elongated wing has a distal end and a proximal end; the concave recess of the elongated wing having a center line parallel to the leading edge of the elongated wing; the center line and leading edge being oriented at an acute angle relative to the longitudinal axis of the tool shank, wherein a distance between the most distal end of the leading edge of the elongated wing and the longitudinal axis of the tool shank is less than a distance between the most proximal end of the leading edge of the elongated wing and the longitudinal axis of the tool shank, the curved pry tab being sized and shaped for inserting the leading edge of the concave recess of the curved pry tab under the rim of the paint can lid and used to pry off the paint can lid.

12. The method of manufacturing of claim 11, further comprising securing a hammer plate to the substantially cylindrical handle.

* * * * *